US009331432B1

(12) United States Patent
Phillips

(10) Patent No.: US 9,331,432 B1
(45) Date of Patent: May 3, 2016

(54) ELECTRICAL CONNECTOR HAVING BUSSED GROUND CONTACTS

(71) Applicant: Tyco Electronics Corporation, Berwyn, PA (US)

(72) Inventor: Michael John Phillips, Camp Hill, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 25 days.

(21) Appl. No.: 14/519,593

(22) Filed: Oct. 21, 2014

(51) Int. Cl.
*H01R 13/648* (2006.01)
*H01R 13/6471* (2011.01)
*H01R 24/60* (2011.01)
*H01R 107/00* (2006.01)

(52) U.S. Cl.
CPC ..... *H01R 13/6471* (2013.01); *H01R 24/60* (2013.01); *H01R 2107/00* (2013.01)

(58) Field of Classification Search
CPC ..... H01R 13/6471; H01R 24/60; H01R 2107/00; H01R 12/774; H01R 13/652; H01R 12/777; H01R 12/613; H01R 13/6485
USPC ..... 439/607.05
See application file for complete search history.

(56) References Cited

U.S. PATENT DOCUMENTS 4,743,080 A * 5/1988 Siraty ..... H01R 12/613 439/271
5,567,169 A * 10/1996 McCleerey ..... H01R 13/6485 439/181
6,595,796 B1 * 7/2003 Koegel ..... H01R 12/777 439/495
7,112,072 B2 * 9/2006 Korsunsky ..... H01R 13/652 439/108
8,142,233 B2 * 3/2012 Niitsu ..... H01R 12/774 439/708

* cited by examiner

*Primary Examiner* — Jean F Duverne

(57) ABSTRACT

A contact assembly for an electrical connector includes a holder and multiple ground contacts and signal contacts. The ground contacts and signal contacts are held by the holder along an outer side of the holder. The ground contacts and the signal contacts each have a mating segment proximate to a front end of the holder and a terminating segment proximate to a rear end of the holder. Ground contacts nearest to each other define a contact spacing therebetween. The nearest ground contacts are mechanically connected by a bridge member that connects the mating segments of the nearest ground contacts to electrically common the ground contacts. At least one signal contact is disposed in the contact spacing between the nearest ground contacts. The ground contacts provide electrical shielding between the signal contacts that are in different contact spacings.

20 Claims, 4 Drawing Sheets

ELECTRICAL CONNECTOR HAVING BUSSED GROUND CONTACTS

BACKGROUND OF THE INVENTION

The subject matter herein relates generally to electrical connectors that have ground buses that electrically common ground contacts.

Typically, high speed electrical connectors experience significant electrical interference, such as cross-talk and resonant frequency noise, within the mating interface zone where two electrical connectors electrically engage each other. For example, within the mating interface zone, high speed connectors may exhibit resonance spikes, which degrade signal transmission performance of the connectors. To improve performance by reducing the electrical interference in the mating interface zone, some known electrical connectors include discrete ground bars that are placed in either the plug connector or the receptacle connector. The ground bars typically have beam style contacts that extend into mechanical contact with ground contacts of the plug connector and/or the receptacle connector.

However, adding additional deflectable beams complicates efforts to control alignment between the contacts of the plug and receptacle connectors and increases the normal forces exerted between the contacts during mating. For example, the beams of the ground bars are additional moving components with a separable interface that must align properly with the ground contacts of the plug and receptacle connectors to function properly. As such, the ground bars that include deflectable beam style contacts add a level of complexity to the connector assembly and may be unreliable due to mismanagement of the mechanical forces and/or alignment between the beam contacts of the ground bars and the ground contacts of the plug and receptacle connectors. A need remains for a simple and reliable structure for electrically connecting or tying ground contacts together in the mating interface zone of an electrical connector.

BRIEF DESCRIPTION OF THE INVENTION

In an embodiment, a contact assembly for an electrical connector includes a holder, multiple ground contacts, and multiple signal contacts. The holder extends between a front end and a rear end. The ground contacts are held by the holder along an outer side of the holder. The ground contacts each have a mating segment proximate to the front end of the holder and a terminating segment proximate to the rear end of the holder. Ground contacts nearest to each other define a contact spacing therebetween. The nearest ground contacts are mechanically connected by a bridge member that connects the mating segments of the nearest ground contacts to electrically common the ground contacts. The signal contacts are held by the holder along the outer side of the holder. The signal contacts each have a mating segment proximate to the front end of the holder and a terminating segment proximate to the rear end of the holder. At least one signal contact is disposed in the contact spacing between the nearest ground contacts. The ground contacts provide electrical shielding between the signal contacts that are in different contact spacings.

In another embodiment, an electrical connector includes a shell, a contact assembly, and plural cables. The shell has a cable end and a mating end. The shell defines a cavity. The cavity extends between a cable opening at the cable end and a mating opening at the mating end. The contact assembly is held in the shell. The contact assembly includes a holder, multiple ground contacts, and multiple signal contacts. The holder extends longitudinally between a front end and a rear end. The ground contacts and the signal contacts each have a mating segment proximate to the front end and a terminating segment proximate to the rear end. The ground contacts and the signal contacts are interspersed laterally across a width of the holder. The mating segments of the ground contacts are mechanically connected to the mating segments of the nearest ground contacts via bridge members to electrically common the ground contacts. The cables are terminated to the contact assembly within the cavity of the shell. The cables extend from the cable end of the shell through the cable opening. The cables each include at least one signal conductor and at least one grounding element. The signal conductors of the cables terminate to the terminating segments of the signal contacts. At least one grounding element of each cable terminates to the terminating segment of one of the ground contacts.

In an embodiment, an electrical connector includes a shell, a contact module, and plural cables. The shell has a cable end and a mating end. The shell defines a cavity. The cavity extends between a cable opening at the cable end and a mating opening at the mating end. The contact module is held in the cavity of the shell. The contact module has first and second contact assemblies that each includes a holder, multiple signal contacts, and multiple ground contacts. The holders each have an inner side and an outer side. The inner side of the holder of the first contact assembly faces the inner side of the holder of the second contact assembly such that the outer sides face outward. The signal contacts and ground contacts are held along the outer side of the respective holder. Distal tips of the ground contacts of each contact assembly extend from the outer side of the respective holder in an interior direction towards the inner side and towards the distal tips of the ground contacts of the other of the first or second contact assembly. The distal tips of nearest ground contacts of each contact assembly are mechanically connected to each other via bridge members. The bridge members are disposed within an interior region of the respective holder between the outer side and the inner side. The cables are terminated to the contact module within the cavity of the shell. The cables extend from the cable end of the shell through the cable opening.

DETAILED DESCRIPTION OF THE INVENTION

Figure 1:
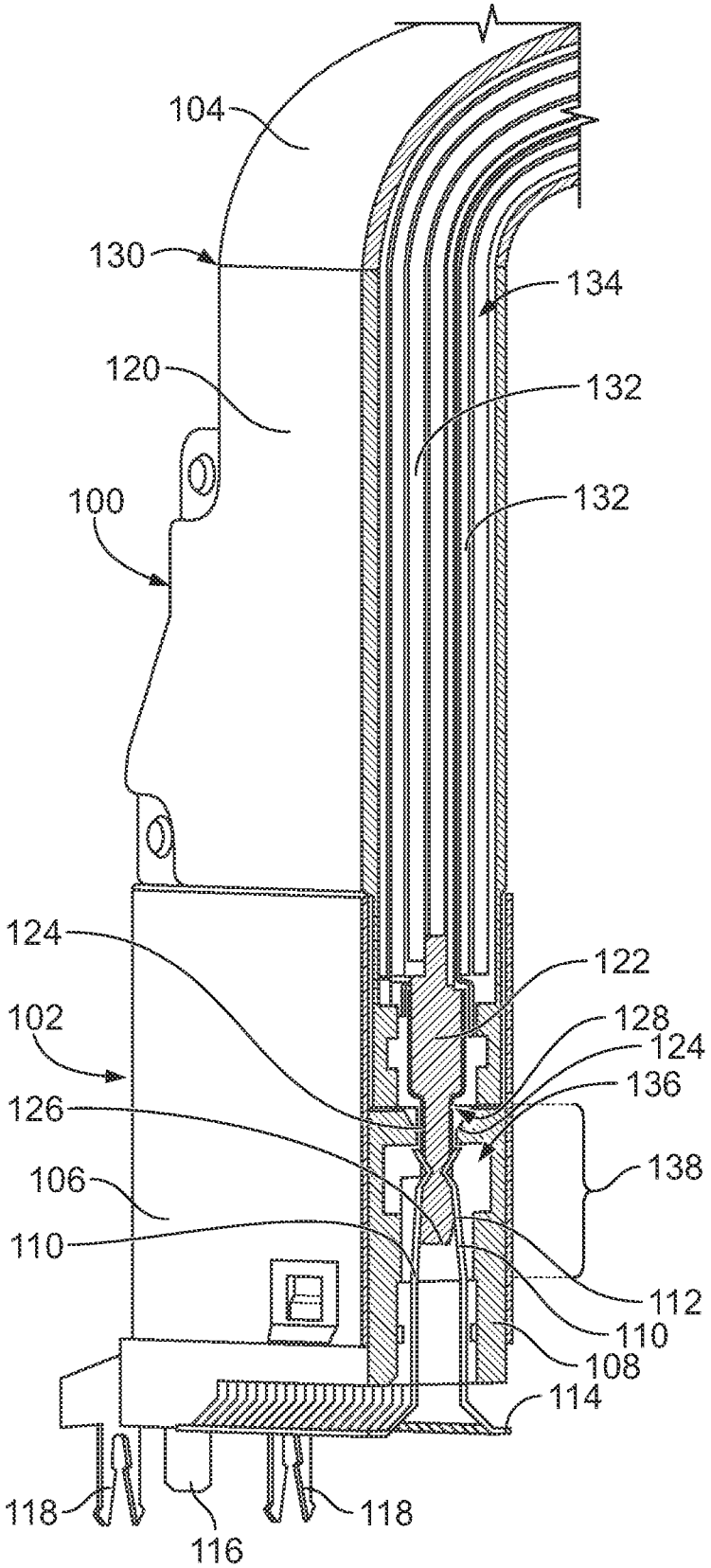
FIG. 1 is a perspective cross-section of two mated electrical connectors according to an embodiment.

FIG. 1 is a perspective cross-section of two mated electrical connectors according to an embodiment. The electrical connectors include a first connector 100 and a second connector 102. The electrical connectors 100, 102 may be high speed connectors that transmit data signals at speeds between 25 and 50 gigabits per second (Gb/s), or more. For example, the electrical connectors 100, 102 may be high speed transceiver-type connectors. The data signals may be optical signals conveyed via fiber optics and/or electrical signals conveyed via conductive wires. The first electrical connector 100 is shown in FIG. 1 as a cable-mount connector that is terminated to a cable 104. The second electrical connector 102 is shown as a vertical board-mount connector that is configured to be mounted to a circuit board (not shown). The first connector 100 may be a plug connector and the second connector 102 may be a receptacle connector. As used herein, the first electrical connector 100 may be referred to as plug connector 100 or plug electrical connector 100, and the second electrical connector 102 may be referred to as receptacle connector 102 or receptacle electrical connector 102. In one or more alternative embodiments, the first connector 100 may be the receptacle, and the second connector 102 may be the plug.

The receptacle connector 102 includes a shell 106 that at least partially surrounds a housing 108. The housing 108 holds a plurality of receptacle contacts 110. The receptacle contacts 110 have deflectable contact beams 112 and mounting feet 114. The mounting feet 114 are configured to be mounted, such as by soldering, adhesives, or mechanical fasteners, to contact pads of the circuit board. The housing 108 includes at least one post 116 configured to be through-hole mounted to the circuit board. The shell 106 may also include a fastener that couples the shell 106 to the circuit board. For example, the shell 106 may include multiple sets of retention clips 118 that engage the circuit board. The mounting feet 114, post 116, and/or retention clips 118 hold the receptacle connector 102 on the circuit board.

The plug connector 100 includes a shell 120 that at least partially surrounds a contact module 122 that holds multiple plug contacts 124. A front end 126 of the contact module 122 extends forward from a mating opening 128 of the shell 120. As used herein, relative or spatial terms such as "front," "rear," "top," "bottom," "first," and "second" are only used to distinguish the referenced elements and do not necessarily require particular positions or orientations in one or both of the electrical connectors 100, 102 relative to gravity or relative to the surrounding environment of the electrical connectors 100, 102. The cable 104 extends from a rear, cable end 130 of the shell 120. The cable 104 includes multiple sub-cables 132 that enter a cavity 134 of the shell 120 and terminate to the plug contacts 124 of the contact module 122.

When the plug connector 100 and the receptacle connector 102 are mated, as shown in FIG. 1, the front end 126 of the contact module 122 of the plug connector 100 enters an opening or socket 136 defined by the housing 108 of the receptacle connector 102. The plug contacts 124 on the contact module 122 mechanically and electrically engage the receptacle contacts 110 in a mating interface zone 138. For example, the mating interface zone 138 may be the area within the socket 136 of the housing 108, where the plug contacts 124 are exposed to and engage the receptacle contacts 110, and vice-versa. The electrical connection between the contacts 124, 110 provides a signal path through the connectors 100, 102 between the cable 104 and the circuit board, for example.

Electrical interference, such as cross-talk and resonant frequency noise spikes, is typically a concern in the mating interface zone 138. The electrical interference increases with increasing electrical throughput. Some known high-speed connector assemblies install a discrete ground bus bar in the mating interface zone 138. The ground bus bar is designed to electrically common ground contacts of the plug and/or the receptacle, which reduces the resonance spikes in the mating interface zone. The ground bus bar typically includes multiple beam-style contacts that are configured to engage the plug contacts, the receptacle contacts, or both during a mating operation. As described above, introducing another separable contact interface in addition to the interface between corresponding plug and receptacle contacts is complicated and may be unreliable. For example, the force applied by the contact beam of the ground bus bar on the receptacle contact may interfere with the engagement between the receptacle contact and the plug contact, disrupting or breaking the electrical connection across the connectors. In another example, one or more of the contact beams of the ground bus bar may not engage the plug contact or the receptacle contact due to misalignment, for example, which prevents the ground bus bar from providing grounding to that contact pair. In one or more embodiments of the inventive subject matter described herein, the plug connector 100 includes a ground bus bar in the mating interface zone 138 formed by bridge members that link adjacent or nearest ground contacts together. The bridge members may be formed integral with the ground contacts. The bridge members may be surrounded or encased by the contact module 122. As a result, the ground bus bar described herein avoids problems associated with having beam-style contacts extending from a fixed platform, where the beam-style contacts must be specially aligned and formed to properly engage the plug contacts and/or the receptacle contacts during a mating operation.

Figure 2:
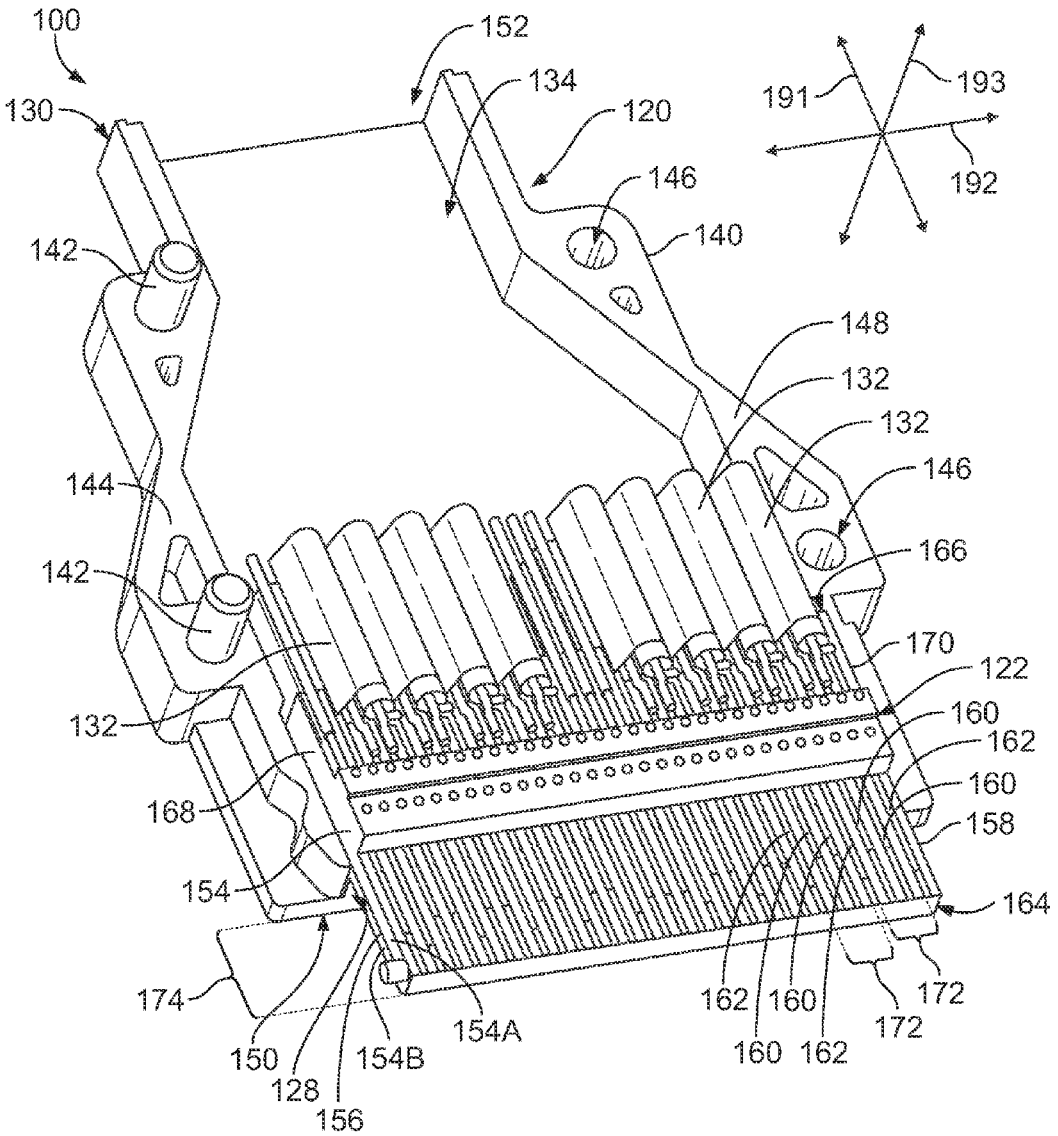
FIG. 2 is a perspective view of a plug electrical connector according to an embodiment.

FIG. 2 is a perspective view of the plug electrical connector 100 according to an embodiment. The plug electrical connector 100 includes the shell 120, the contact module 122, and the cables 132. The plug connector 100 is oriented with respect to a longitudinal axis 191, a lateral axis 192, and a vertical or elevation axis 193. The axes 191-193 are mutually perpendicular. Although the elevation axis 193 appears to extend in a vertical direction parallel to gravity in FIG. 2, it is understood that the axes 191-193 are not required to have any particular orientation with respect to gravity.

The shell 120 may be formed by coupling two half shells. In FIG. 2, only a lower half shell 140 of the two half shells is shown. The upper half shell (not shown) and the lower half shell 140 may be identical and hermaphroditic, such that the upper half shell mirrors the lower half shell 140. The lower half shell 140 and the upper half shell includes complementary coupling features. For example, the lower half shell 140 includes two posts 142 that protrude from a first wall 144 and two post-receiving holes 146 in an opposite second wall 148. The upper half shell may also have the same coupling features, such that when the upper half shell placed over the lower half shell 140, the posts 142 are received in holes of the upper half shell, and the holes 146 receive posts of the upper half shell. The coupling features secure the upper half shell to the lower half shell 140 to define the shell 120. The shell 120 extends longitudinally (for example, along the longitudinal axis 191) between the cable end 130 and a mating end 150. The shell 120 defines the cavity 134 between the cable end 130 and the mating end 150, and between the first wall 144 and the second wall 148. The cable end 130 includes a cable opening 152. The mating end 150 defines the mating opening 128. The cavity 134 extends between the cable opening 152 and the mating opening 128.

The sub-cables 132 of the cable 104 (shown in FIG. 1) terminate to the contact module 122 within the cavity 134. As used herein, the sub-cables 132 may be referred to as cables 132. In FIG. 2, only proximal portions of the cables 132 are shown in order to better illustrate the structure of other components, such as the shell 120. Therefore, although not shown, the cables 132 extend through the cavity 134 and out of the shell 120 through the cable opening 152 at the cable end 130. Out of the shell 120, the cables 132 are commonly surrounded by a jacket layer to define the cable 104, as shown in FIG. 1.

The contact module 122 in an embodiment includes two contact assemblies 154. For example, the contact module 122 in FIG. 2 has a first contact assembly 154A and a second contact assembly 154B. The first and second contact assemblies 154A, 154B are adjacent to each other. In FIG. 2, the first contact assembly 154A is above the second contact assembly 154B. The contact assemblies 154A, 154B may abut each other at a crease 156. Alternatively, the contact assemblies 154A, 154B may be spaced apart via an intermediary panel (not shown). Although two contact assemblies 154A, 154B are shown in the illustrated embodiment, the contact module 122 may include only one contact assembly 154 or more than two contact assemblies 154 in other embodiments. Each contact assembly 154A, 154B includes a holder 158 that holds multiple signal contacts 160 and multiple ground contacts 162. The signal contacts 160 and ground contacts 162 define the plug contacts 124 shown in FIG. 1. The holder 158 and contacts 160, 162 of each contact assembly 154A, 154B may be identical or at least substantially similar. Thus, the following description may correspond to either contact assembly 154A, 154B.

The holder 158 extends longitudinally between a front end 164 and a rear end 166. The holder 158 extends laterally between a left side 168 and a right side 170. The signal contacts 160 and the ground contacts 162 are interspersed across a width of the holder 158 (for example, between the left and right sides 168, 170 along the lateral axis 192). The signal contacts 160 and the ground contacts 162 may extend parallel to each other along the longitudinal axis 191. Ground contacts 162 that are nearest to each other define a contact spacing 172 therebetween. As used herein, nearest ground contacts 162 refers to two ground contacts 162 that are not separated from each other by any other ground contacts 162. At least one signal contact 160 is disposed in the contact spacing 172 between the two ground contacts 162. The nearest ground contacts 162 may be referred to herein as adjacent ground contacts 162, although it is understood that the nearest or adjacent ground contacts 162 may be separated by one or more signal contacts 160. In an embodiment, two signal contacts 160 are within each contact spacing 172, such that the signal and ground contacts 160, 162 are arranged in a repeating ground-signal-signal-ground-signal-signal pattern. The ground contacts 162 provide electrical shielding between the signal contacts 160 that are in different contact spacings 172. For example, one ground contact 162 provides shielding between two signal contacts 160 located on respective opposite sides of the ground contact 162. In other embodiments, the signal and ground contacts 160, 162 may be arranged in other patterns, such as an alternating signal-ground-signal-ground pattern.

The front end 164 of the holder 158 is configured to be inserted into an opening of a mating connector, such as the socket 136 (shown in FIG. 1) of the receptacle connector 102 (FIG. 1), during a mating operation. For example, the front end 164 of the holder 158 may define the front end 126 (FIG. 1) of the contact module 122. A front portion 174 of the holder 158 that includes the front end 164 extends forward from the mating end 150 of the shell 120 through the mating opening 128. When the plug connector 100 mates to the receptacle connector 102, the front portion 174 of the holder 158 enters the socket 136 of the housing 108 (FIG. 1), but the shell 120 does not. The front portion 174 of the holder 158 holds portions of the signal and ground contacts 160, 162 which also enter the socket 136 during mating.

Figure 3:
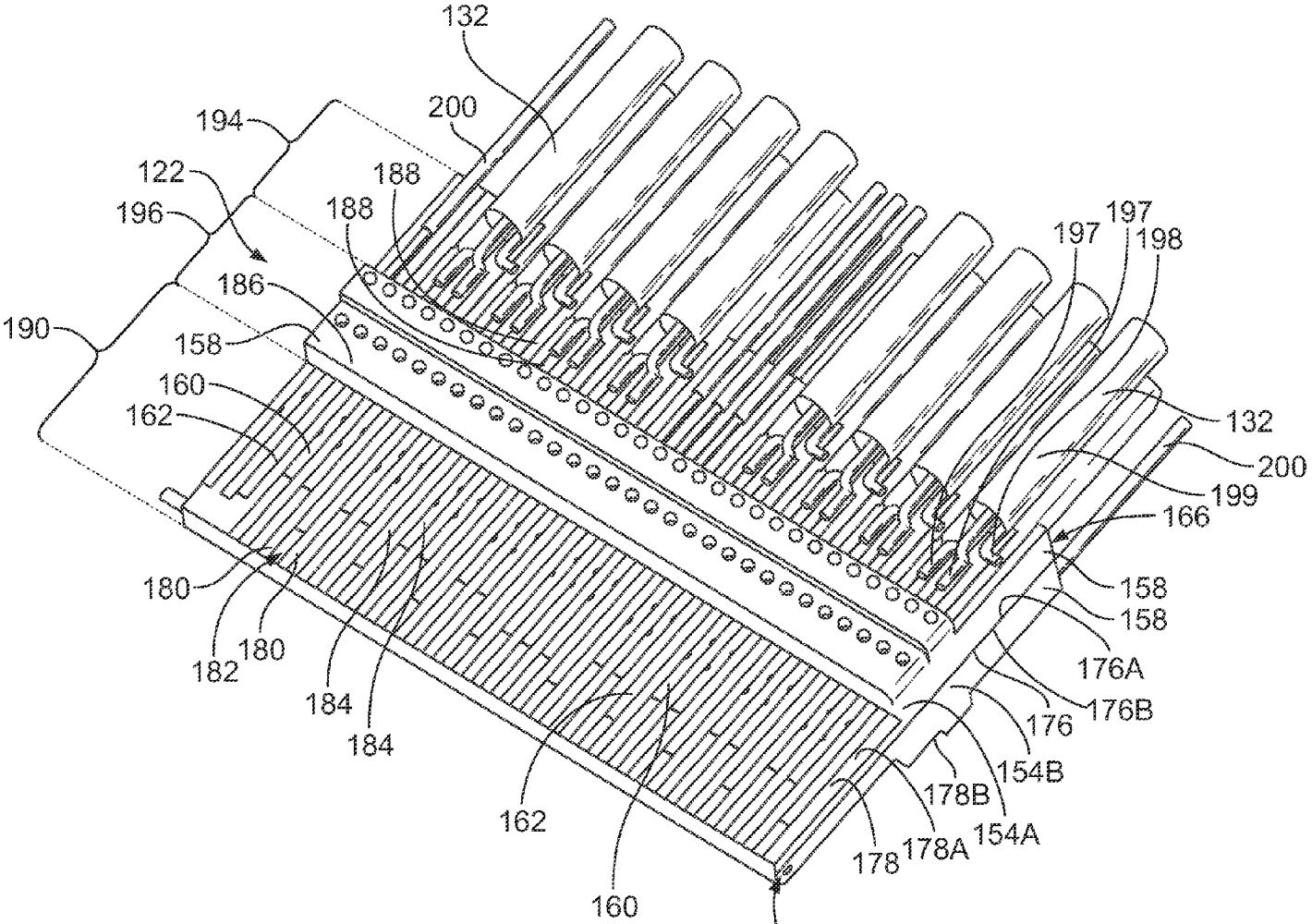
FIG. 3 is a perspective view of a contact module and cables of the plug electrical connector according to an embodiment.

FIG. 3 is a perspective view of the contact module 122 and cables 132 of the plug electrical connector 100 (shown in FIGS. 1 and 2) according to an embodiment. The contact module 122 has the two contact assemblies 154A, 154B shown in FIG. 2. The holder 158 of each contact assembly 154A, 154B includes an inner side 176 and an outer side 178. The inner side 176A of the holder 158 of the first contact assembly 154A faces the inner side 176B of the holder 158 of the second contact assembly 154B. For example, the inner sides 176A, 176B may be pressed into engagement with each other. The outer sides 178A, 178B of the holders 158 of the first and second contact assemblies 154A, 154B face outwards. The signal contacts 160 and the ground contacts 162 are held along the outer side 178 of the respective holder 158. Only the signal and ground contacts 160, 162 of the first contact assembly 154A are visible in FIG. 3. The arrangement of the contacts 160, 162 on the outer sides 178A, 178B allows the contacts 160, 162 to engage mating contacts (such as the receptacle contacts 110 shown in FIG. 1) on either side of the contact module 122 when the contact module 122 is loaded into the socket 136 (shown in FIG. 1) of the receptacle connector 102 (FIG. 1).

The holder 158 may include ridges 180 along the outer side 178. The ridges 180 extend longitudinally and define tracks 182 therebetween. The ground contacts 162 and the signal contacts 160 are disposed in the tracks 182 between the ridges 180, which hold the contacts 160, 162 in place. For example, the ridges 180 and the tracks 182 may hold the contacts 160, 162 on the holder 158, and may hold the contacts 160, 162 at predefined positions relative to each other, thereby preventing electrical shorts that would occur if the contacts 160, 162 were to engage each other. For example, the contacts 160, 162 may be embedded in the tracks 182 between the surrounding ridges 180.

In an embodiment, the holder 158 has a dielectric overmold body 186. The holder 158 may be formed in a molding process in which dielectric material is injected into a mold around the contacts 160, 162. The dielectric material may be a polymer or a polymer compound. The dielectric material molds around the contacts 160, 162 and forms the overmold body 186. The signal and ground contacts 160, 162 may be embedded in the overmold body 186. As described below, at least part of the contacts 160, 162 may be encased (for example, encompassed or fully surrounded) by the dielectric overmold body 186 of the holder 158, which may occur during the molding process.

The signal contacts 160 and the ground contacts 162 each have a mating segment 184 that is proximate to the front end 164 of the holder 158 and a terminating segment 188 that is proximate to the rear end 166 of the holder 158. The mating segments 184 are configured to engage mating contacts (such as the receptacle contacts 110 shown in FIG. 1). The terminating segments 188 are configured to engage conductive components of the cables 132 to terminate the contacts 160, 162 to the cables 132. The mating segments 184 need not be at the front end 164 of the holder 158, but are at least more proximate to the front end 164 than the proximity of the terminating segments 188 to the front end 164. Likewise, the terminating segments 188 need not be at the rear end 166, but are at least more proximate to the rear end 166 than the proximity of the mating segments 184 to the rear end 166. In an embodiment, the mating segments 184 of the ground contacts 162 are longer and extend farther towards the front end 164 of the holder 158 than the mating segments 184 of the signal contacts 160. Alternatively, the mating segments 184 of the ground contacts 162 may be equal to or shorter than the mating segments 184 of the signal contacts 160.

The holder 158 includes a front tray 190 that holds the mating segments 184 of the contacts 160, 162, and a rear tray 194 that holds the terminating segments 188 of the contacts 160, 162. The mating segments 184 and the terminating segments 188 of the contacts 160, 162 may be held flat and planar to the outer sides 178 of the respective front and rear trays 190, 194. The holder 158 may also include a base portion 196 disposed longitudinally between the front and rear trays 190, 194. The base portion 196 divides the front and rear trays 190, 194 and also may be used to secure the contacts 160, 162 to the holder 158. For example, the contacts 160, 162 may extend through the base portion 196 such that the portion of the contacts 160, 162 through the base portion 196 is encased by the overmold body 186 of the holder 158.

The cables 132 each include at least one signal conductor 197 and at least one grounding element 198. Each signal conductor 197 is terminated to the terminating segment 188 of a different signal contact 160. One grounding element 198 of each cable 132 is terminated to the terminating segment 188 of one ground contact 162. The at least one signal conductor 197 may be a metal wire. The at least one grounding element 198 may be a cable shield, such as a metallic foil layer, a cable braid, a drain wire, or the like. The signal conductors 197 and the grounding elements 198 may be terminated to the terminating segments 188 of the respective contacts 160, 162 by soldering, welding, adhesives, mechanical fasteners, or the like. The cables 132 in an embodiment are twin axial cables that include two signal conductors 197 and a drain wire grounding element 198 commonly surrounded by a cover layer 199 for insulation and protection. The two signal conductors 197 may define a differential signal pair. As such, each cable 132 may terminate to two signal contacts 160 and one ground contact 162. In alternative embodiments, at least some of the cables 132 may have other than two signal conductors 197. In the illustrated embodiment, the contact module 122 further includes multiple single-ended wires 200. The single-ended wires 200 include a signal conductor 197 and a cover layer 199. The single-ended wires 200 terminate to signal contacts 160 but not ground contacts 162, and are not used for high-speed data transmissions, unlike the cables 132.

Figure 4:
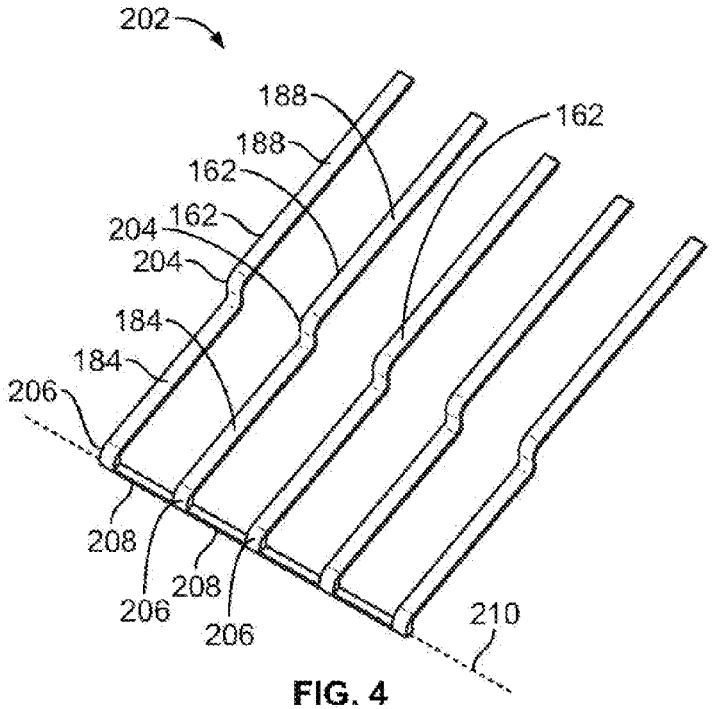
FIG. 4 is a perspective view of a grounding frame of the plug electrical connector according to an embodiment.

FIG. 4 is a perspective view of a grounding frame 202 of the plug electrical connector 100 (shown in FIGS. 1 and 2) according to an embodiment. The grounding frame 202 includes at least some of the ground contacts 162 of one contact assembly 154A or 154B (shown in FIG. 3). In an embodiment, the mating segments 184 of the ground contacts 162 are separated from the terminating segments 188 by a jogged section 204. The jogged section 204 forms an S-shape that steps the terminating segment 188 of the ground contact 162 outward to a different plane relative to the mating segment 184. Due to the jogged section 204, the terminating segment 188 is offset from the mating segment 184. In an embodiment, the signal contacts 160 (shown in FIG. 3) have jogged sections similar to the jogged sections 204 of the ground contacts 162. Referring back to FIG. 3, the jogged sections 204 may be disposed within the base portion 196 of the holder 158. The base portion 196 may encase or encompass the jogged sections 204 to hold the contacts 160, 162 in place on the holder 158. The terminating segments 188 of the signal and ground contacts 160, 162 along the rear tray 194 are further outward (from the inner side 176 of the holder 158) than the mating segments 184, which provides more space for the cables 132 at the rear end 166 of the holder 158.

Referring now back to FIG. 4, the mating segments 184 of the ground contacts 162 extend from the jogged sections 204 to distal tips 206. The distal tips 206 of adjacent ground contacts 162 in the grounding frame 202 may be mechanically connected to each other by bridge members 208. The bridge members 208 link the adjacent ground contacts 162 together, which electrically commons the ground contacts 162. The distal tips 206 of the ground contacts 162 are ends of the ground contacts 162 most proximate to the front end 164 (shown in FIG. 3) of the holder 158 (FIG. 3). As such, when the front portion 174 (shown in FIG. 2) of the holder 158 enters the socket 136 (FIG. 1) of the housing 108 (FIG. 1) of the receptacle connector 102 (FIG. 1) during mating, the bridge members 208 electrically common the ground contacts 162 in the mating interface zone 138 (FIG. 1).

The bridge members 208 may extend in a line 210 across a width of the grounding frame 202. The line 210 extends transverse to the orientation of the ground contacts 162. The bridge members 208 at the distal tips 206 of the ground contacts 162 may be the only mechanical connections between the ground contacts 162. Alternatively, the grounding frame 202 may include multiple bridge members 208 along the length of the ground contacts 162 that connect the same two adjacent ground contacts 162. For example, in addition to the bridge member 208 connecting the distal tips 206, an additional bridge member may connect the same two ground contacts 162 along the mating segments 184 closer to the jogged section 204. In an alternative embodiment, instead of connecting the distal tips 206, the bridge member 208 may be spaced apart from the distal tips 206 such as closer to the jogged sections 204.

In an embodiment, the bridge members 208 are integral to the ground contacts 162, and the grounding frame 202 is a unitary, one piece conductive structure. For example, the grounding frame 202 may be stamped and formed from a panel of metal to include the ground contacts 162 and connecting bridge members 208. In an alternative embodiment, the grounding frame 202 is constructed by fastening discrete bridge members 208 to discrete ground contacts 162.

In an embodiment, the mating segments 184 of the ground contacts 162 are planar, and the distal tips 206 of the ground contacts 162 extend out of plane from the mating segments 184. The distal tips 206 may be curved or otherwise angled away from the mating segments 184. As a result, the bridge members 208 that connect the distal tips 206 may be stepped or offset from the mating segments 184, as described with reference to FIG. 5 below.

Figure 5:
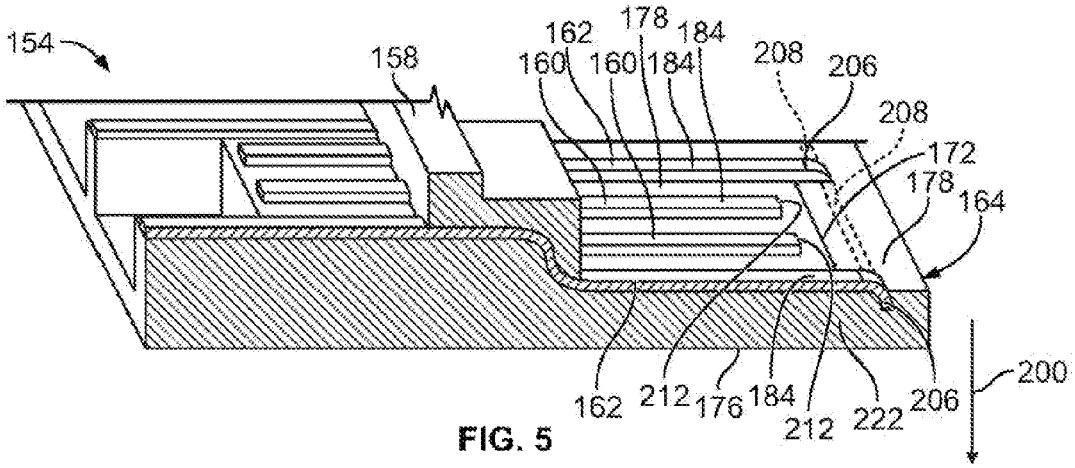
FIG. 5 is a perspective cross-section of a portion of a contact assembly of the plug electrical connector according to an embodiment.

FIG. 5 is a perspective cross-section of a portion of a contact assembly 154 of the plug electrical connector 100 (shown in FIG. 1) according to an embodiment. The contact assembly 154 may be the first contact assembly 154A in the contact module 122 shown in FIG. 3. Although not shown, the inner side 176 (shown in FIG. 3) of the second contact assembly 154B (FIG. 3) may abut or at least face the inner side 176 of the holder 158 shown in FIG. 5. The cross-section shown in FIG. 5 extends through one ground contact 162 and the holder 158.

The mating segments 184 of the signal contacts 160 and the ground contacts 162 extend planar along the outer side 178 of the holder 158. In an embodiment, the distal tips 206 of the ground contacts 162 extend from the outer side 178 in an interior direction 220 towards the inner side 176. The distal tips 206 extend into an interior region 222 of the holder 158 that is between the outer side 178 and the inner side 176. Since the second contact assembly 154B (shown in FIG. 3) may be disposed along the inner side 176 of the contact assembly 154 shown in FIG. 5, the distal tips 206 may extend towards the distal tips of the ground contacts of the second contact assembly, and vice versa.

The bridge members 208 that connect the distal tips 206 of the ground contacts 162 may be at least partially disposed in the interior region 222 of the holder 158. For example, the bridge members 208 may be partially embedded in the holder 158 such that only a portion of each bridge member 208 is in the interior region 222. Optionally, the bridge members 208 are encased within the holder 158 such that the bridge members 208 are fully covered or surrounded by the holder 158 within the interior region 222 between the inner and outer sides 176, 178. For example, the curved distal tips 206 may be embedded, while the bridge members 208 may be encased. As shown in FIG. 5, the bridge members 208 are shown in phantom because the bridge members 208 are in the interior region 222 below the outer side 178.

In an embodiment, the ground contacts 162 extend closer to the front end 164 than the signal contacts 160, and the distal tips 206 of the ground contacts 162 are therefore more proximate to the front end 164 than distal ends 212 of the signal contacts 160. Therefore, the bridge members 208, which extend across the contact spacings 172 between the distal tips 206, are spaced apart longitudinally from the distal ends 212 of the signal contacts 160. The bridge members 208 are more proximate to the front end 164 than the distal ends 212, so the bridge members 208 do not interfere with the signal contacts 160. In addition, the bridge members 208 may be disposed along a different plane between the inner and outer sides 176, 178 than the signal contacts 160, such that the bridge members 208 would not mechanically contact and interfere with the signal contacts 160 even if the signal contacts 160 extend across the bridge members 208.

In an embodiment, the bridge members 208 electrically common the ground contacts 162 within the mating interface zone 138 (shown in FIG. 1) to reduce resonance spikes and other electrical interference in the mating interface zone 138. Furthermore, the bridge members 208 are integral to the contact module 122 (shown in FIG. 1), which avoids the issues inherent with controlling beam style contacts of known ground bars that form separable mating interfaces with the receptacle and/or plug contacts. The embodiments of the plug electrical connector 100 (shown in FIGS. 1 and 2) described herein may be easier to assemble and more reliable than known electrical connectors that have ground bars in the mating zone.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. A contact assembly for an electrical connector comprising:

a holder extending between a front end and a rear end;

multiple ground contacts held by the holder along an outer side of the holder, the ground contacts each having a mating segment proximate to the front end of the holder and a terminating segment proximate to the rear end of the holder, ground contacts nearest to each other defining a contact spacing therebetween, the nearest ground contacts being mechanically connected by a bridge member that connects the mating segments of the nearest ground contacts to electrically common the ground contacts; and multiple signal contacts held by the holder along the outer side of the holder, the signal contacts each having a mating segment proximate to the front end of the holder and a terminating segment proximate to the rear end of the holder, at least one signal contact being disposed in the contact spacing between the nearest ground contacts, wherein the ground contacts provide electrical shielding between the signal contacts that are in different contact spacings.

2. The contact assembly of claim 1, wherein the bridge members are integral to the ground contacts as part of a unitary, one piece conductive structure.

3. The contact assembly of claim 1, wherein the bridge members connect distal tips of the mating segments of the nearest ground contacts, the distal tips being embedded in the holder along the outer side and the bridge members being encased by the holder between the outer side and an opposite inner side of the holder.

4. The contact assembly of claim 3, wherein the mating segments of the ground contacts are planar and extend along the outer side of the holder, the distal tips of the mating segments extending in an interior direction into an interior region of the holder such that the bridge members connecting the distal tips are disposed in the interior region of the holder between the outer side and the inner side of the holder.

5. The contact assembly of claim 1, wherein each mating segment of the signal contacts and the ground contacts is separated from the corresponding terminating segment by a jogged section that steps the terminating segment outward to a different plane relative to the mating segment.

6. The contact assembly of claim 1, wherein the holder has a dielectric overmold body, the ground contacts and the signal contacts being at least partially embedded in the overmold body to hold the ground contacts and signal contacts in place.

7. The contact assembly of claim 1, wherein the electrical connector is a plug connector, the front end of the holder being configured to be inserted into an opening of a mating receptacle connector, the bridge members configured to electrically common the ground contacts of the plug connector within the opening of the mating receptacle connector.

8. An electrical connector comprising:

a shell having a cable end and a mating end, the shell defining a cavity, the cavity extending between a cable opening at the cable end and a mating opening at the mating end;

a contact assembly held in the shell, the contact assembly including a holder, multiple ground contacts, and multiple signal contacts, the holder extending longitudinally between a front end and a rear end, the ground contacts and the signal contacts each having a mating segment proximate to the front end and a terminating segment proximate to the rear end, the ground contacts and the signal contacts interspersed laterally across a width of the holder, the mating segments of the ground contacts being mechanically connected to the mating segments of nearest ground contacts via bridge members to electrically common the ground contacts; and plural cables terminated to the contact assembly within the cavity of the shell, the cables extending from the cable end of the shell through the cable opening, the cables each including at least one signal conductor and at least one grounding element, the signal conductors of the cables terminating to the terminating segments of the signal contacts, the grounding elements of the cables terminating to the terminating segments of the ground contacts.

9. The electrical connector of claim 8, wherein the at least one grounding element includes at least one of a cable shield, a cable braid, or a drain wire.

10. The electrical connector of claim 8, wherein the contact assembly is a first contact assembly and the electrical connector further includes a second contact assembly, the holders of the first and second contact assemblies each including an inner side and an outer side, the inner side of the holder of the first contact assembly facing the inner side of the holder of the second contact assembly, the signal contacts and ground contacts of the respective first and second contact assemblies held along the outer sides of the respective holders.

11. The electrical connector of claim 8, wherein the bridge members are integral to the ground contacts as part of a unitary, one piece conductive structure.

12. The electrical connector of claim 8, wherein the bridge members extend between distal tips of the mating segments of the nearest ground contacts, the mating segments of the ground contacts are planar and extend along an outer side of the holder, the distal tips of the mating segments extending in an interior direction into an interior region of the holder such that the bridge members connecting the distal tips are disposed in the interior region of the holder between the outer side and an opposite inner side of the holder.

13. The electrical connector of claim 8, wherein the holder includes ridges that define tracks therebetween, the ground contacts and the signal contacts being disposed in the tracks to hold the ground contacts and signal contacts in place.

14. The electrical connector of claim 8, wherein the front end of the holder and the mating segments of the ground and signal contacts extend from the mating end of the shell through the mating opening to be received within an opening of a mating receptacle connector.

15. An electrical connector comprising:

a shell having a cable end and a mating end, the shell defining a cavity, the cavity extending between a cable opening at the cable end and a mating opening at the mating end;

a contact module held in the cavity of the shell, the contact module having first and second contact assemblies that each include a holder, multiple signal contacts, and multiple ground contacts, the holders each have an inner side and an outer side, the inner side of the holder of the first contact assembly facing the inner side of the holder of the second contact assembly such that the outer sides face outward, the signal contacts and ground contacts being held along the outer side of the respective holder, distal tips of the ground contacts of each contact assembly extending from the outer side of the respective holder in an interior direction towards the inner side and towards the distal tips of the ground contacts of the other of the first or second contact assembly, the distal tips of nearest ground contacts of each contact assembly being mechanically connected to each other via bridge members, the bridge members being disposed within an interior region of the respective holder between the outer side and the inner side; and plural cables terminated to the contact module within the cavity of the shell, the cables extending from the cable end of the shell through the cable opening.

16. The electrical connector of claim 15, wherein the signal contacts and the ground contacts of the first and second contact assemblies each have a mating segment and a terminating segment, the holders of the first and second contact assemblies each having a front tray that holds the mating segments of the signal and ground contacts and a rear tray that holds the terminating segments of the signal and ground contacts.

17. The electrical connector of claim 16, wherein the cables each include at least one signal conductor and at least one grounding element, the signal conductors of the cables terminating to the terminating segments of the signal contacts, the grounding elements of the cables terminating to the terminating segments of the ground contacts.

18. The electrical connector of claim 15, wherein the holders of the first and second contact assemblies each have a dielectric overmold body, the ground contacts and the signal contacts being at least partially embedded in the overmold body to hold the ground contacts and signal contacts in place.

19. The electrical connector of claim 15, wherein the bridge members are integral to the ground contacts as part of a unitary, one piece conductive structure.

20. The electrical connector of claim 15, wherein the nearest ground contacts of each contact assembly define a contact spacing therebetween and at least one signal contact is disposed in the contact spacing, the ground contacts extending farther towards a front end of the respective holder than the signal contacts such that the bridge members extending across the contact spacings to connect the nearest ground contacts are more proximate to the front end than distal ends of the signal contacts.

* * * * *